US008690711B2

(12) United States Patent
Ko et al.

(10) Patent No.: US 8,690,711 B2
(45) Date of Patent: Apr. 8, 2014

(54) DATA DISPLAY ON GOLF BALL OUTER SURFACE

(75) Inventors: Chin-Shun Ko, Kaohsiung (TW); Chen-Tai Liu, Yun-lin Hsien (TW)

(73) Assignee: NIKE, Inc., Beaverton, OR (US)

( * ) Notice: Subject to any disclaimer, the term of this patent is extended or adjusted under 35 U.S.C. 154(b) by 121 days.

(21) Appl. No.: 13/090,063

(22) Filed: Apr. 19, 2011

(65) Prior Publication Data

US 2012/0270671 A1 Oct. 25, 2012

(51) Int. Cl.
*A63B 37/00* (2006.01)

(52) U.S. Cl.
USPC ..... 473/351

(58) Field of Classification Search
USPC ..... 473/351, 353, 199–200
See application file for complete search history.

(56) References Cited

U.S. PATENT DOCUMENTS

| | | | |
|---|---|---|---|
| 4,775,948 | A | 10/1988 | Dial et al. |
| 5,761,096 | A | 6/1998 | Zakutin |
| 5,779,576 | A | 7/1998 | Smith, III et al. |
| 6,148,271 | A | 11/2000 | Marinelli |
| 6,151,563 | A | 11/2000 | Marinelli |
| 6,157,898 | A | 12/2000 | Marinelli |
| 6,428,432 | B1 | 8/2002 | Kachel |
| 6,565,449 | B2 | 5/2003 | Buhler |
| 6,884,180 | B2 | 4/2005 | Corzilius et al. |
| 7,273,431 | B2 | 9/2007 | DeVall |
| 2003/0216228 | A1 | 11/2003 | Rast |
| 2005/0233815 | A1 | 10/2005 | McCreary et al. |
| 2008/0220892 | A1 | 9/2008 | Williamson et al. |
| 2009/0253526 | A1 | 10/2009 | Koudele et al. |
| 2009/0280921 | A1 | 11/2009 | Rankin |
| 2010/0069181 | A1 | 3/2010 | Lin |

FOREIGN PATENT DOCUMENTS

| | | | |
|---|---|---|---|
| CN | ZL201220166025.5 | | 3/2013 |
| EP | 1232772 | | 8/2002 |
| GB | 2190846 | A | 12/1987 |
| GB | 2208438 | A | 3/1989 |
| GB | 2440510 | A | 6/2008 |
| JP | 6210041 | | 8/1994 |
| WO | 2005028035 | | 3/2005 |

OTHER PUBLICATIONS

Examiner's Report for Canadian Patent Application No. 2,772,650 mailed on Jun. 27, 2012.

Notification of First Office Action in Chinese Utility Application No. 201220166025.5, mailed on Sep. 12, 2012 and English translation thereof.

Extended European Search Report in EPO Patent Application No. EP12164742.4, mailed on Oct. 2, 2012.

Commissioner's Report issued Mar. 5, 2013 for Australian Patent Application No. 2012201842.

Notification of Grant of Patent Right for Utility Model issued on Dec. 12, 2012 for Chinese Utility Model Patent Application No. 201220166025.5.

Communication pursuant to Rules 70(2) and 70a(2) EPC and reference to Rule 39(1) EPC mailed Nov. 6, 2012 for European Patent Application No. 12164742.4.

Notice of Allowance mailed Nov. 22, 2012 for Canadian Patent Application No. 2,772,650.

*Primary Examiner* — Raeann Gorden
(74) *Attorney, Agent, or Firm* — Plumsea Law Group, LLC

(57) ABSTRACT

A plurality of layers and elements are incorporated into a golf ball to display values for various swing characteristics on a display layer of a ball. A calculator is incorporated to calculate a value of at least one swing characteristic. A weighted light source is incorporated to display the value on a display layer. The display layer is a substantially opaque layer.

14 Claims, 3 Drawing Sheets

DATA DISPLAY ON GOLF BALL OUTER SURFACE

FIELD

The present disclosure relates to an apparatus for providing information to a golfer regarding his or her swing during a round of golf. More specifically, the present disclosure relates to a golf ball that includes a calculator for calculating the value of a swing characteristic and a light that is configured to display the value on a generally upward surface of the ball.

BACKGROUND

Golf is traditionally a difficult sport to learn. While a golfer can learn many concepts about a swing at a driving range, once the golfer reaches the golf course, it may be difficult for the golfer to determine why particular golf shots are traveling in errant directions or inappropriate distances. This may be because golfing on a course includes a number of factors that are not replicated at a driving range. These factors may include grass of varying lengths, hazards such as divot marks, uneven terrain for footing, uneven landing areas, wind, rain, and the like. In addition, while a golfer is improving his or her game, he or she may be less able to determine the selection of an appropriate club without feedback regarding other swings he or she may have taken.

In many instances, a golfer may have a habitual pattern to his or her golf swing. This habitual pattern may include a habitual error. While a golfer may be able to correct such an error while in a low-pressure and low-stress environment like the driving range, the golfer may be less able to focus on the error when in a more multi-factored environment, such as a golf course, where other people are playing in his or her foursome and there may be other golfers and obstacles on the course to navigate.

Certain patterns may emerge in such a situation that does not mimic the results of swings on a practice tee. These patterns may be unfamiliar to a golfer, and the golfer may be baffled about how to correct such a pattern while in a game situation. While other members of the foursome may be helpful to the golfer, it is also possible or likely that golfers at the same experience level may give the golfer poor advice on how to correct the swing defects.

Accordingly, it may be helpful to a golfer to be able to have access to objective data to be able to determine what errors the golfer may be making, so that he or she can correct his or her swing. It is known in the golf industry to embed a sensor to detect data relating to a swing into a ball and to transmit that data to another device, such as a handheld device or a remote device. It is also known in other industries to include a display on a ball of data sensed from a sensor in the ball, so that no other equipment is required. However, such a system has not been used in the golf industry, due to stresses on the ball and the force of impact a golf ball must endure. Displays commonly used for such applications are unable to withstand the force of impact of a golf club and, in some cases, with the ground or other obstacles on a course, and therefore, do not have the durability necessary to be used in golf applications.

What is desirable instead is a ball that is self-contained, in that a golfer may use the ball to determine his or her swing characteristics without having to purchase or synchronize other equipment. In addition, what is desirable is that the ball be designed so that the cover of the ball can function as a display to inform the golfer of the swing characteristics just by the golfer viewing the ball. In this manner, the golfer can have the desired information with no additional equipment to carry or purchase, while the ball has adequate durability to be played with conventional equipment on a conventional course.

SUMMARY

The present embodiments relate to a golf ball that includes an embedded calculator for calculating a value of one or more swing characteristics, a light source capable of transmitting such a value, and a display where a golfer can read the value. These elements are all located within a golf ball. A golfer can use the data provided by the calculator in the ball to modify a golf swing, keep track of his or her score, or otherwise evaluate various qualities of his or her game. Because all the required elements of sensing, calculation, and display are all contained within the ball, the ball may be the only equipment necessary to retrieve the data generated within the ball.

In one embodiment, a golf ball capable of displaying at least one swing characteristic is disclosed. The golf ball may include a calculator, a cushion layer, at least one intermediate layer, a display, and a light source. The calculator may be capable of calculating a value for at least one swing characteristic. The cushion layer may surround the calculator. The at least one intermediate layer may surround the cushion layer. The display may be positioned relative to the light source in a manner such that the display is capable of displaying the calculated value. The light source is capable of transmitting light from the calculator to the display and thereby displaying the calculated value on the display. The ball may further include a weight capable of orienting the light source in a generally upward direction.

In another embodiment, a golf ball incorporating a display device for displaying data on a golf ball layer is disclosed. The golf ball may include a light source, a weight, and a display layer. The light source may have three degrees of rotational freedom and may be positioned in a central region of a golf ball. A weight may be attached to the light source and may orient the light source in a generally upward direction. The display layer may be continuous and may be configured to display light emitted from the light source when the light source is positioned in any rotational position.

In another embodiment, a device for displaying at least one swing characteristic on a layer of a ball is disclosed. The device includes a calculator, a light source, a weight, a cushion layer, at least one intermediate layer, and a display layer. The calculator, light source, and weight may be attached to one another and may be encapsulated in a sphere. The sphere may be located in a central area of the ball. The calculator may be capable of calculating at least one swing characteristic. The cushion layer may surround the encapsulated sphere. The cushion layer may also be designed to permit movement of the encapsulated sphere independent of movement of the ball. The at least one intermediate layer may surround the cushion layer. The display layer may encapsulate the intermediate layer. The light source and the display layer may be configured to permit the light source to display a value for the at least one swing characteristic at any location on the display layer. The weight, calculator, and light source may be attached to one another in a manner such that the weight is capable of orienting the light source to project light to display on the display layer in a generally upward direction.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The balls described in the present disclosure each have a number of components that cooperate to provide data about at least one swing characteristic to a golfer. This data is displayed on a layer of the ball in order to allow the golfer to have the data without reliance on additional equipment to retrieve the data.

Figure 1:
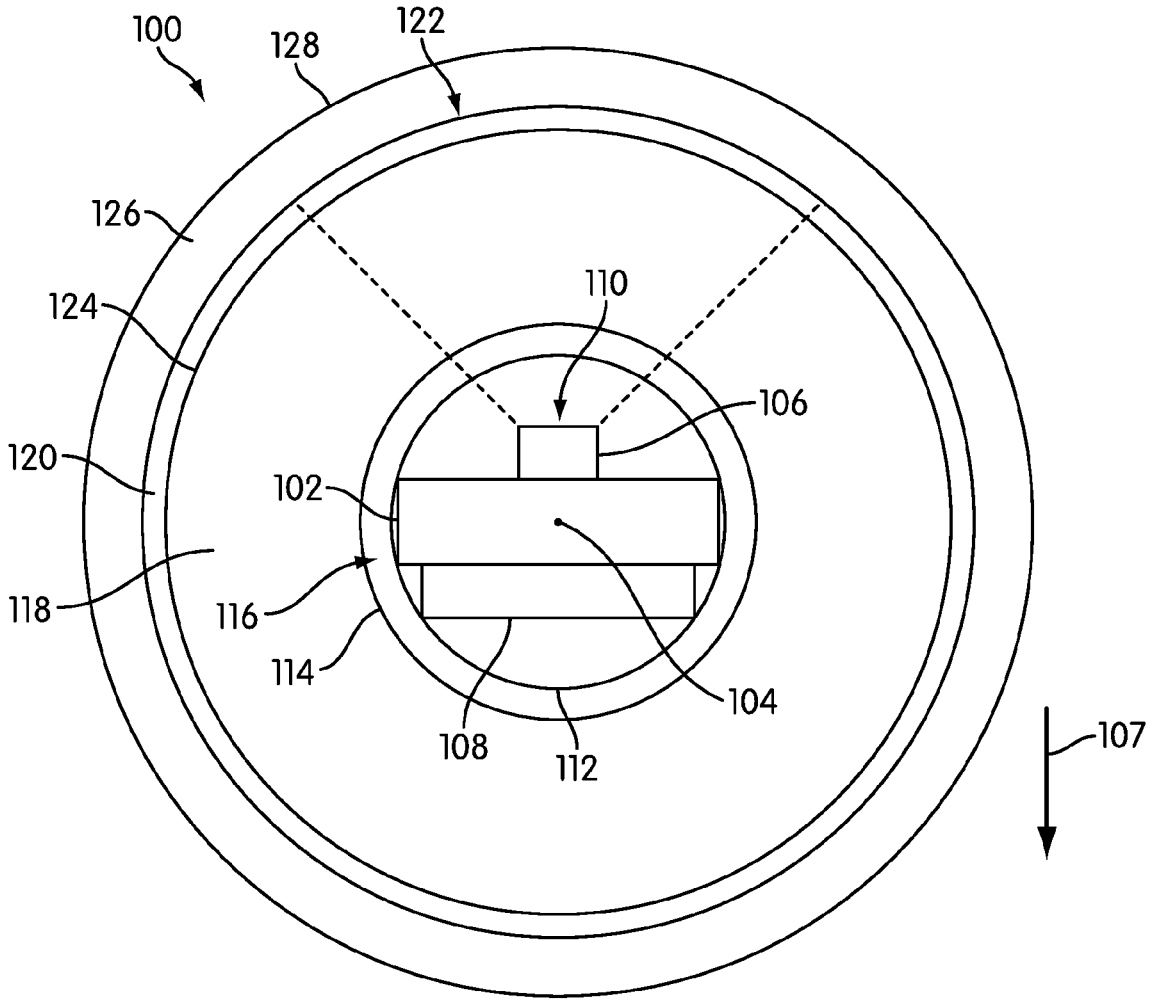
FIG. 1 is a cross-sectional view of a first alternative embodiment of a ball according to the present disclosure.

FIG. 1 is a cross-sectional view of a first embodiment of a ball 100. Ball 100 may include a calculator 102. Calculator 102 is located in a central area of ball 100 and may in some embodiments be positioned so that it is about at the center 104 of ball 100. Calculator 102 may include a number of components.

Calculator 102 may include a power source. In many embodiments, the power source may be a battery. The battery may be rechargeable. The battery may be rechargeable through the rotational motion common in golf balls or may be rechargeable through a non-contact charge apparatus, as is conventional in the rechargeable battery industry. The exact configuration of the battery and the method of recharging the battery may not be critical in many embodiments, and a person having ordinary skill in the art is able to select from any conventional system that would have the appropriate wattage, current, and storage capacity for the remainder of the elements selected, while maintaining an appropriate size and weight for use in the context of the size of the ball.

Calculator 102 may further include a processor to calculate a value of a swing characteristic. Processors that may be embedded in balls to determine values for various types of swing characteristics are generally well-known. A conventional microprocessor may be used in many embodiments. The microprocessor may be designed to calculate any of a variety of swing characteristics that may be desirable. In another embodiment, one or more nanocomputers may be used as the processor.

Calculator 102 may further include a memory. In some embodiments, it may be desirable for the calculator to save a value for further use. A golfer may wish to view data from a single shot. However, the golfer may also wish to view data from a plurality of shots. For example, in some embodiments, it may be desirable to know an average distance a ball travels in the air when hit with a particular club. In other embodiments, a golfer may wish to remember the overall number of shots that have been hit using the ball as a method for double-checking a score. Retaining this information in a memory may be useful in these or other circumstances. In addition, the memory may store data or equations necessary or desirable for making calculations for particular swing characteristics.

Calculator 102 may further include a plurality of switches. In order to preserve battery life, calculator 102 may include a timer switch that puts the microprocessor in a sleep mode and deactivates the microprocessor and other power-using features after a period of non-use. Calculator 102 may also include an on switch. The on switch may be activated in any conventional manner, such as by impact between ball 100 and a surface. In some embodiments, it may be desirable for a golfer to activate calculator 102 by bouncing the ball directly on the ground to generate an impact. In other embodiments, it may be desirable for a golfer to activate calculator 102 by beginning to play with ball 100, such as by striking ball 100 with a club. In other embodiments, calculator 102 may be activated by shaking, rolling, or other motion that would be available to any golfer.

Calculator 102 also may include various circuitry or wiring that allows the elements within calculator 102 to be electrically connected to one another. This circuitry is well-known and can easily be constructed by a person having ordinary skill in the art. The circuitry may be wired or wireless, depending on the preferences and desires of the designer.

Calculator 102 may also be connected to light source 106. Light source 106 is capable of generating a visible message to a user representing the value of a particular swing characteristic calculated by the calculator. Light source 106 may be any style of light source. In some embodiments, light source 106 may include its own battery, and in other embodiments, light source 106 may be powered by the battery included in calculator 102. In many embodiments, it may be desirable to use a light source 106 that has a low power usage, so that the life of the associated battery may be as long as possible. In some embodiments, light source 106 may be an LED. In other embodiments, light source 106 may be a laser. In other embodiments, light source 106 may be an incandescent light.

In many embodiments, the wattage of light desirable for the present embodiments may be relatively low. In some embodiments, light source 106 may be a laser with a maximum output of 1 mW. In some embodiments, the light source may project light having a brightness value between about 10 lumens and about 40 lumens. The color of the light emitted from light source 106 may be any desirable color. In some embodiments, it may be desirable to use a color for the projected light that contrasts with a typical white color of a conventional golf ball and that is easily transmitted by a laser or LED. In some embodiments, the color of the projected light may be red or green, but in other embodiments, the color of the projected light may be any color desired by the designer or requested by customers. In some embodiments, the color may be selectable by the customer as will be described in further detail below.

In many embodiments, a weight 108 is incorporated and may be attached to light 106 and calculator 102. In many embodiments, weight 108 may be relatively small or light in weight. It may be desirable in many embodiments to maintain the overall weight of ball 100 within the regulations of the USGA and to maintain the weight of ball 100 as being as radially symmetrical as possible. Accordingly, weight 108 may be relatively small or light in weight. A purpose of weight 108 in many embodiments may be to orient light source 106 relative to gravity. The force of gravity is shown generally as arrow 107 in FIG. 1. Light source 106 may include a display direction 110. Display direction 110 may be the direction from which light radiates or is projected or emitted from light source 106. In many embodiments, it is desirable for the display direction to be generally upward, generally opposite from the force of gravity. When the display direction is upward, a golfer may more easily view the information displayed than if, for example, the display direction were downward. If the display direction is generally downward toward the force of gravity, the golfer may be unable to view the information without lifting the ball from its place or using a mirror or other device to read the information. Because it is generally contrary to the rules of golf to lift a ball on the fairway, except in unusual circumstances, displaying the information in a downward direction may create difficulties for a golfer who wishes to receive and use information or data from each shot taken.

Because a golfer may desire to view and use this data or information from each shot, it is desirable for the light transmitting the data from the calculator to be visible after each shot. Accordingly, if a fixed display location is to be used, it is impossible to guarantee that such a display is visible at the end of each shot. In addition, if display direction 110 is fixed, a similar complication ensues. It is desirable for display direction to be variable and for ball 100 to be designed to allow display direction 110 to be upward in many circumstances.

Light source 106 may be positioned in a central region of ball 100 and may be attached to weight 108 in a manner which gives light source 106 three degrees of rotational freedom. Light source 106 may be nowhere constrained to pivot about any point or axis. Regardless of the three dimensional final rest position of ball 100, light source 106 may be free to rotate to any rotational position.

Accordingly, it is desirable for light source 106 and weight 108 to be attached in a manner so that display area 110 of light source 106 is facing generally upward away from gravity and weight 108 is facing generally downward towards gravity. In the embodiment shown in FIG. 1, light source 106 and weight 108 are both also attached to calculator 102, but this attachment may be for convenience or packaging reasons. Because a purpose of weight 108 is to orient display area 110, weight 108 may only need to be slightly heavier than light source 106 in order to bias the orientation of display direction 110 in a generally upward direction. In many embodiments, it may not be essential for display direction to be directly upward, but instead, it is desirable in many embodiments for the data displayed to be in the upper half of ball 100 and any location on an upper half of ball 100 may be considered to be generally upward. Accordingly, the weight need not be more than slightly heavier than required to bias rotation to the orientation generally shown in FIG. 1.

In many embodiments, calculator 102, light source 106, and weight 108 may be positioned in and enclosed or encapsulated in a central area of ball 100. In some embodiments, calculator 102, light source 106, and weight 108 may be enclosed within a fluid-tight shell 112. Fluid tight shell 112 may be spherical and may be made from a material that is sufficiently resilient to deform when ball 100 comes into contact with a surface, such as a golf club, the ground, or another surface, but has sufficient strength to give some measure of protection to the elements encapsulated within. Shell 112 is shown in FIG. 1 as being spherical, but shell 112 need not have a spherical shape. Shell or capsule 112 may, for example, be molded to conform to the shape of the elements encapsulated therein. Alternatively, shell 112 may be a thin membrane, such as a polyethylene film, in which calculator 102, light source 106, and weight 108 may be sealed.

A bladder 114 may surround capsule 112. Bladder 114 may be filled with fluid 116. Fluid 116 may serve as a cushion layer or shock absorber layer for capsule 112 and the elements encapsulated therein. In general, golf balls are subjected to high impacts, such as from clubs and the like. When another object or surface comes into contact with ball 100, it may tend to shift the position of capsule 112. Fluid 116 may be selected to have a viscosity that is sufficiently high to dampen the motion of capsule 112. Fluid 116 may also have a viscosity that is sufficiently high and that has an appropriate density such that capsule 112 remains suspended within bladder 114 when ball 100 is at rest. Fluid 116 may also be designed to permit or encourage the rotation of capsule 112 within bladder 114. Because it is desirable for capsule 112 to have the orientation relative to gravity that is generally shown in FIG. 1 when ball 100 is at rest, capsule 112 may desirably be designed to rotate freely within bladder 114 so that it can reach the orientation shown in FIG. 1. The selection of fluid 116 may also use this feature as a factor.

In some embodiments, bladder 114 need not be a separate element. In some embodiments, bladder 114 may simply be an inner surface of intermediate layer 118. Intermediate layer 118 may be one or a plurality of layers that surround bladder 114, cushion or fluid layer 116, capsule 112, and the elements encapsulated within capsule 112. Intermediate layer 118 may be any of a plurality of thermoplastic or thermoset materials conventionally used to manufacture golf balls. Because it is desirable for ball 100 to perform as nearly as possible identically to conventional balls, so a golfer's use of ball 100 mimics his or her use of his or her typical ball, the material selected for intermediate layer 118 may be selected to create a similar coefficient of restitution, compression, and the like, similar to conventional balls. In some embodiments, intermediate layer 118 may be a plurality of superposed layers of different materials, in order to combine the properties of the different layers to create an appropriate response from ball 100.

Surrounding intermediate layer 118 may be display layer 120. Display layer 120 may be selected to display the light emitted from display area 110 on light source 106. Display layer 120 in many embodiments may be substantially opaque. Display layer 120 may be made of an appropriate material with an appropriate color and thickness to display the light emitted from display area 110 on light source 106 to a viewer looking at ball 100. The light emitted from display area 110 may be shown on viewing area 122. Viewing area 122 may be the area on display layer 120 between the dashed lines. The dashed lines generally represent the extent of display layer 120 that can receive light emitted from display area 110. When the emitted light reaches display layer 120, the emitted light may become viewable by a golfer using ball 100. In some embodiments, viewing area may be between about 15 mm by about 15 mm and about 35 mm by about 35 mm.

Display layer 120 may be selected from a variety of materials. In some embodiments, display layer 120 may be made of paper, thermoplastic resins such as urethanes or ionomers, or thermoset resins. Display layer 120 may be a solid material or may be a mesh. Alternatively, display layer 120 may be a paint applied to outer surface 124 of intermediate layer 118. In some embodiments, display layer 120 may have a thickness between about 0.1 mm and about 2 mm, more preferably between about 0.1 mm and about 1.7 mm, and most preferably between about 0.2 mm and about 1.5 mm. In many embodiments, it is desirable that display layer 120 be a continuous surface in order to provide an appropriate display region or viewing area 122 in any region of display layer 120.

Display layer 120 may desirably be white in color. In many embodiments, a white display surface may provide a desirable contrast between the light emitted from light source 106 and the display layer color. Display layer 120 may be substantially opaque. Display layer 120 may not be completely opaque, as in such an instance, none of the light being emitted from light source 106 would be able to be seen by a viewer. However, if display layer 120 is transparent or substantially translucent, the light emitted from light source 106 may not be visible on display layer 120. Accordingly, display layer 120 is sufficiently opaque to permit the light emitted from light source 106 to be visible.

It is desirable that display layer 120 be continuous over its entire surface and surface area. As noted above, light source 106 has three degrees of rotational freedom. When ball 100 comes to a rest position, any point on display layer 120 of ball 100 may hold the uppermost position. Accordingly, any region on display layer 120 may also be the upper region and any region on display layer 120 may be the display or viewing region 122. Because any region on display layer 120 could be viewing region 122, it is desirable that display layer 120 be continuous and have minimal discontinuities in order to display the light emitted from light source 106 clearly to a golfer viewing ball 100 regardless of the final rest orientation of ball 100.

Cover layer 126 may surround display layer 120. In many embodiments, cover layer 126, and in particular, outer surface 128 of cover layer 126, is configured to be struck by a golf club. Accordingly, cover layer 126 may include various dimples, frets or lands, projections, printing, or any other features that a designer thinks would be desirable in affecting the flight path of ball 100. Cover layer 126 may be designed to be scuff resistant. In the FIGS., cover layer 126 is shown in simplified form without these features, as any set of these features that a designer believes are desirable can be incorporated into the present design. Cover layer 126 is shown as being a single cover layer. In some embodiments, a designer may deem it desirable to incorporate a plurality of superposed layers as cover layer 126. This plurality of layers may be referred to as cover layer 126.

It is desirable for many of the layers of ball 100 to be substantially transparent. In order to allow a golfer to see the light emitted from light source 106, it is desirable that the layers between the golfer and the light source be substantially transparent except for display layer 120. Accordingly, it is desirable that capsule 122, liquid 116, bladder 114, intermediate layer 118, and cover layer 126 all be substantially transparent. In some embodiments, some materials may be incorporated that are translucent, rather than substantially transparent. The degree of transparency necessary for any one layer may not be critical, as long as a golfer is able to easily see the data projected onto data layer 120.

Figure 2:
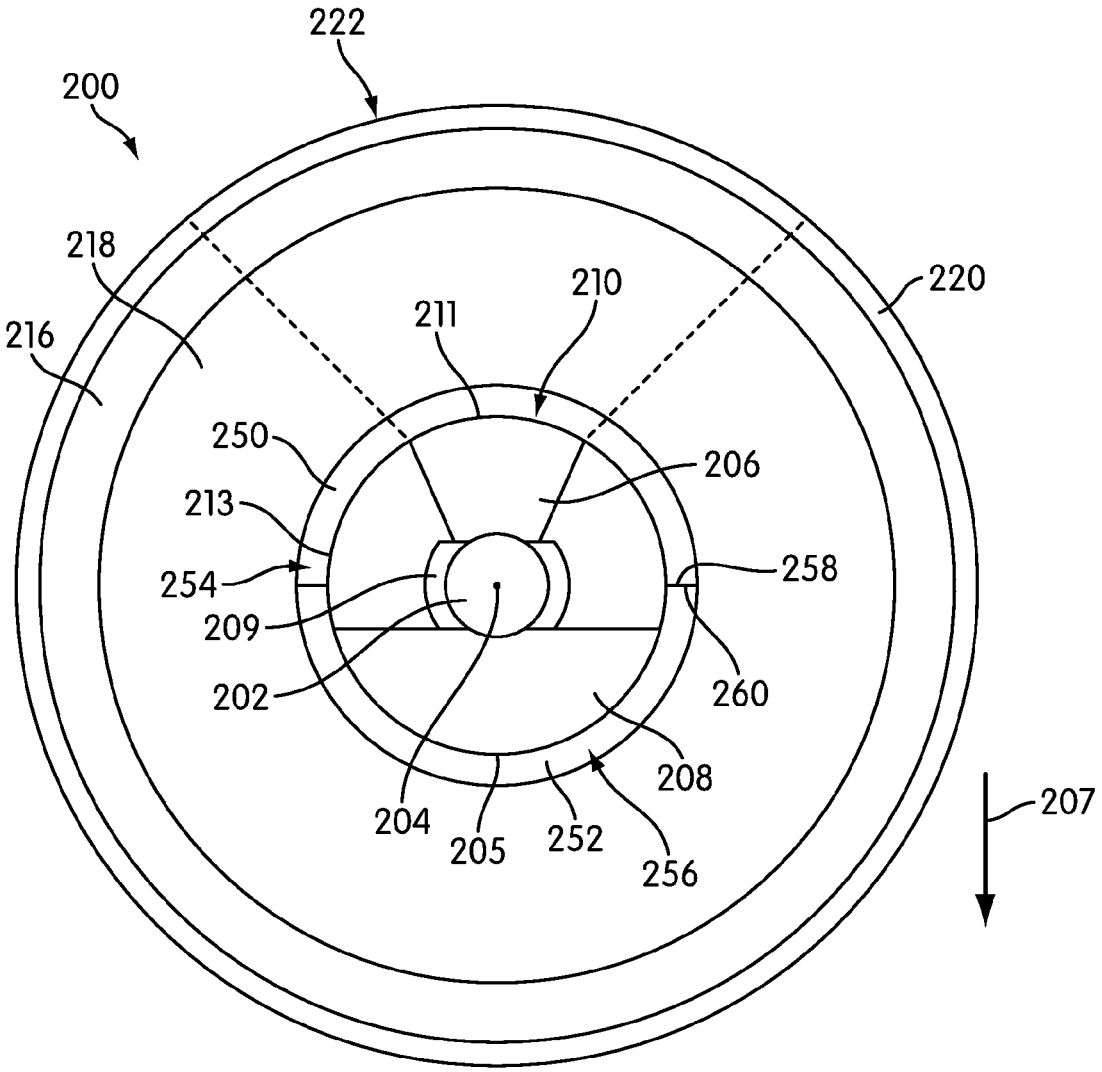
FIG. 2 is a cross-sectional view of another alternative embodiment of a ball according to the present disclosure.

Turning now to FIG. 2, various modifications may be made to the embodiment of FIG. 1. These modifications may be made singly instead of being made together as shown in FIG. 2. A person having ordinary skill in the art can select which modifications may be desirable for his or her design. In the embodiment of FIG. 2, identical words are used for various elements. Where identical words are used, the element of FIG. 2 has the same general properties described in connection with the identically named element of FIG. 1. Only those features that are different from the corresponding elements in FIG. 1 are described.

In FIG. 2, a somewhat different configuration is shown of the elements in the central capsule region. In FIG. 2, calculator 202 is shown as being spherical and placed in the central region of ball 200 near center 204 of ball 200. In FIG. 2, calculator 202 is not secured to any other structure. Light source 206 and weight 208 are secured to one another and may rotate freely and independently around calculator 202. Light source 206 and weight 208 may be configured to be attached to one another by one or more arms 209. Weight 208 and light source 206 are configured so that display direction 210 typically is generally upward, away from the direction generally towards gravity, shown as arrow 207 in FIG. 2. In this embodiment, light source 206 again has three degrees of rotational freedom and may rotate to any position when ball 200 reaches a rest position.

In the embodiment shown in FIG. 2, outer surface 211 of display direction 210 and outer surface 205 of weight 208 are each configured to have an arc shape that separately or together may define a portion of a sphere. These shapes may be configured to conform to an inner surface 213 of a cushion layer that surrounds or encapsulates weight 208, light source 206, and calculator 202. Alternatively or in addition, a separate encapsulation layer, such as a sphere or other encapsulating film or envelope may surround and encapsulate calculator 202, light source 206, and weight 208. Further, if desired, a lubricant may be used between calculator 202 and the portions of weight 208, light source 206, and any related arms 209 that abut calculator 202 to enable the parts to rotate freely and independently of one another. A lubricant may also be applied between the elements of light source 206 and weight 208 that abut inner surface 213 of the cushion layer.

In the embodiment of FIG. 2, the cushion layer or shock absorbing layer may include two bladders. A first bladder 250 may be filled with a first fluid 254 and a second bladder 252 may be filled with a second fluid 256. In many embodiments, first fluid 254 and second fluid 256 may be the same fluid. First bladder 250 may include a first abutting face 258 and second bladder 252 may include second abutting face 260. First abutting face 258 and second abutting face 260 may be secured to one another with any desirable attachment structure or method. In some embodiments, first abutting face 258 and second abutting face 260 may be secured to one another with an adhesive. In the embodiment of FIG. 2, inner surface 213 of the cushion layer formed by first bladder 250 and second bladder 252 may form the capsule that encapsulates calculator 202, light source 206, and weight 208.

Each of first bladder 250 and second bladder 252 may be hollow hemispheres and each may be filled with a fluid to create a designated or desired pressure. When the encapsulated elements are subjected to a force, such as when ball 200 is struck by a club, the fluids in each bladder may apply pressure to the encapsulated elements. This pressure may dampen or cushion the force applied to the encapsulated elements, thereby protecting them. The use of two hemispherical bladders may be desirable in many embodiments, as it allows the bladders to be assembled and filled in an unrelated step, rather than requiring assembly and filling during the process of assembling ball 200.

Intermediate layer 218 may surround the cushion layer. Cover layer 216 may surround intermediate layer 218. Display layer 220 may surround cover layer 216. If display layer 220 is the outermost layer of ball 200, as shown in FIG. 2, it may be desirable in some embodiments to further include a top coat. A top coat may be a thin layer, such as a thin resin layer, that is designed to increase the durability of display layer 220. The top coat may provide additional scuff resistance. If display layer 220 is configured to be the outermost layer of ball 200, viewing area 222 may be able to be larger in size than when the display layer is a layer further inward from the outer surface of ball 200.

The drawings illustrate layers having a variety of thicknesses and other thicknesses have been mentioned in connection with one or more embodiments. These thicknesses should not be considered to be the only possible thicknesses for the layers. The desirable thicknesses for the various layers depends on the materials a designer wishes to use and the protection or reactivity the designer wishes to provide by the various layers. A person having ordinary skill in the art can modify the present embodiments to provide for a ball having layers of appropriate thicknesses. In addition, the elements in the central capsule or region have been illustrated as having various relative sizes and shapes. These sizes and shapes are merely illustrative and may not represent the sizes of elements a designer may select. A person having ordinary skill in the art can modify the present embodiments to provide a ball that includes the elements the designer selects.

Figure 3:
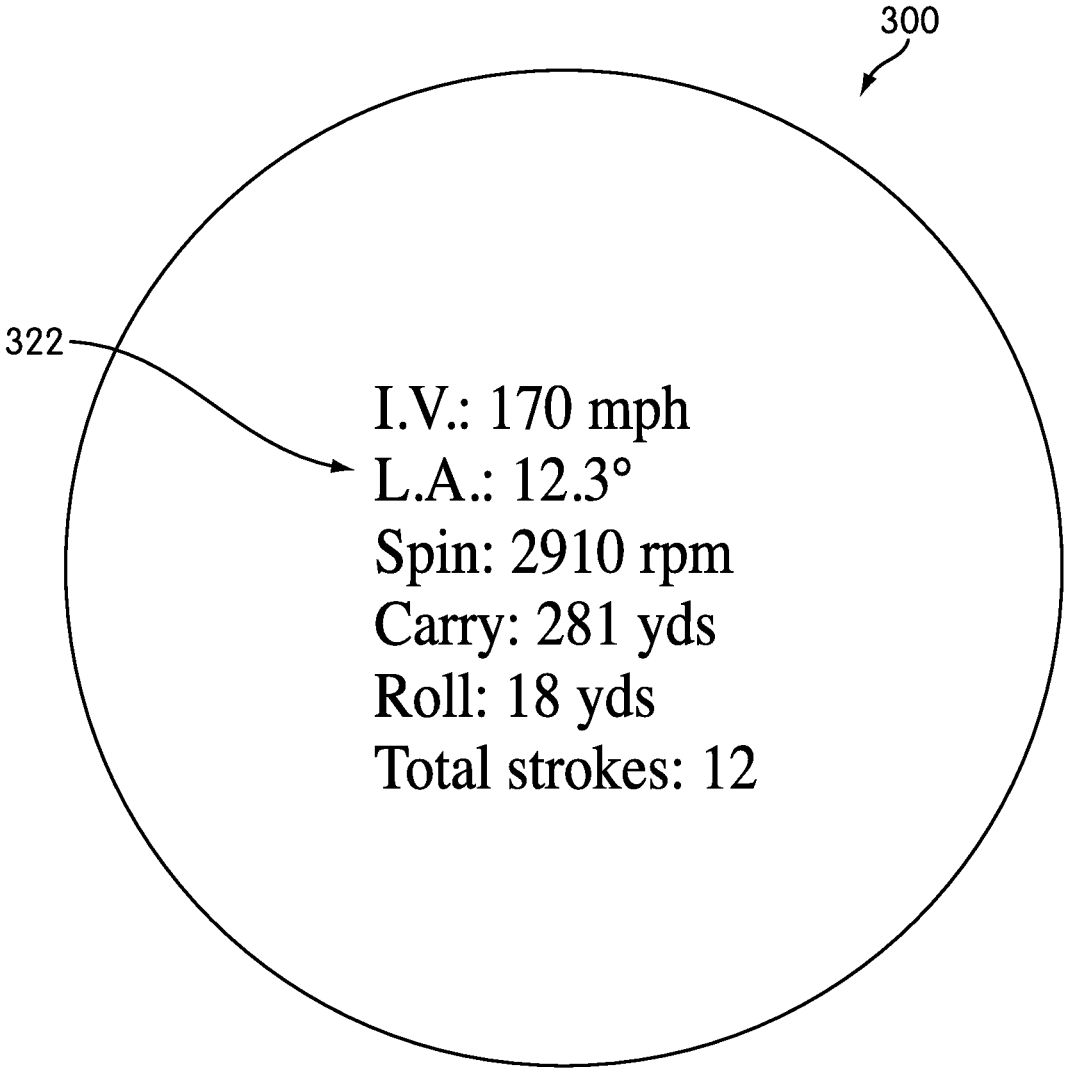
FIG. 3 is a top view of a ball according to the present disclosure.

FIG. 3 shows a ball 300 that is displaying values for a plurality of swing characteristics in a display area 322. These values and these swing characteristics are merely exemplary and a plurality of other characteristics may be evaluated instead of those shown.

The embodiments shown in the present disclosure have been illustrated such that their display areas on their display layers are pointed generally directly upward away from the direction of gravity. The display in a directly upward direction is not specifically required. As shown in FIG. 3, almost half a surface area of a ball may be visible to a golfer looking at a ball. The data may instead be displayed slightly lower on a ball than directly upwards. If such an orientation of the display area is desired, the relative position of the weight and the display direction may be easily modified by a person having ordinary skill in the art to provide a generally upward display area, while not being specifically directly upward.

The embodiment shown in FIG. 3 shows a simultaneous display of a plurality of values of a plurality of swing characteristics. Rather than simultaneously displaying a plurality of values for a plurality of characteristics, the ball may instead display only one characteristic. In another embodiment, the ball may display a continuous scroll of values of various characteristics, either scrolling horizontally or vertically. In another embodiment, the values may flash one after the other. A person having ordinary skill in the art can easily configure the display of the light source to display the data in the manner the designer thinks is appropriate. Alternatively, the method of display may be configurable by a user.

In some embodiments, the golfer may be able to customize many features of a ball. After performing a plurality of actions to reach a selection menu, the golfer may be able to select from a plurality of choices. For example, the golfer may be permitted to select the color of the light, the font, the size of the font, the way the data is displayed (as described above). The user may also be able to configure various timing features, such as the length of time the ball remains active before shutting itself off or the length of time it displays a data regarding a particular swing characteristic. The golfer may also be able to set whether the ball displays only characteristics of a single swing or an average from a previous number of swings.

It may also be desirable to permit a user to reset the memory. It may be that a golfer would desire to retain data for a particular length of play and then to delete the data and start calculating a different set of data. A golfer may wish to make such a change if, for example, he or she purchases a new set of clubs, visits a different course, or simply does not like the results. The golfer may be permitted to reset these features as part of the customization program or through a series of independent manipulations of the ball, such as a pattern of unusual bounces, shakes, and rotations.

The microprocessor or nanocomputer incorporated in the calculator may calculate a variety of swing characteristics. Examples of swing characteristics for which a value could be calculated by the calculator include the ball speed, the spin rate, the launch angle, the flight time, the initial velocity, the carry distance, the roll distance, and the number of strokes. These values may be calculated individually for each shot, and an average or sum over a plurality of strokes may also be calculated. These swing characteristics are merely exemplary, and other values for other characteristics may be calculated and displayed in addition to these specifically enumerated.

A golfer may choose to use a plurality of balls like those disclosed in the same golf round. In some instances, a golfer may wish to keep track of how far he or she typically hits a particular club. In such an instance, the golfer may mark each ball with a different club name and may change his or her ball on the course when he or she selects a different club to use. By using the disclosed balls in this manner, he or she may be able to determine the distance he or she typically hits each club and may be able to determine whether he or she needs additional practice on particular clubs, if the results of one or more clubs are inconsistent with the data from other clubs.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball capable of displaying at least one swing characteristic, the golf ball comprising:

a calculator capable of calculating a value for at least one swing characteristic;

a cushion layer surrounding the calculator;

at least one intermediate layer surrounding the cushion layer;

a light source;

a display positioned relative to a the light source in a manner such that the display is capable of displaying the calculated value; and the light source being capable of transmitting light to the display and thereby displaying the calculated value on the display, wherein the calculator and the light source are attached to one another and are capable of rotating independently of a rotation of the golf ball.

2. The golf ball according to claim 1, further comprising a weight attached to the light source.

3. The golf ball according to claim 1, wherein the weight is capable of orienting the light source in a generally upward direction.

4. The golf ball according to claim 1, wherein the cushion layer comprises a liquid.

5. The golf ball according to claim 4, wherein the cushion layer comprises a liquid having adequate viscosity to suspend the calculator therein.

6. The golf ball according to claim 1, wherein the cushion layer comprises a first hemispherical bladder filled with liquid and having a first abutting face and a second hemispherical bladder filled with liquid and having a second abutting face, the first abutting face and the second abutting face being placed in abutting relationship to one another, the first bladder and the second bladder thereby surrounding the calculator and the light source.

7. The golf ball according to claim 6, wherein the calculator, the light source, and a weight are placed in a spherical capsule.

8. A golf ball incorporating a device for displaying a value for at least one swing characteristic on a layer of a golf ball, the device comprising:

an encapsulated sphere disposed in a center area of a golf ball;

a calculator disposed within the encapsulated sphere, wherein the calculator is capable of calculating at least one golf swing characteristic;

a light source disposed within the encapsulated sphere;

a weight disposed within the encapsulated sphere, wherein the calculator, the light source, and the weight are attached to one another;

a cushion layer surrounding the encapsulated sphere, wherein the cushion layer is designed to permit movement of the encapsulated sphere independent of movement of the golf ball;

at least one intermediate layer surrounding the cushion layer; and a display layer encapsulating the intermediate layer, the light source and the display layer being configured to permit the light source to display a value for the at least one swing characteristic at any location on the display layer.

9. The golf ball according to claim 8, wherein the display layer is substantially opaque.

10. The golf ball according to claim 8, wherein the calculator comprises a microprocessor and a battery.

11. The golf ball according to claim 8, wherein the light source is selected from LED and laser.

12. The golf ball according to claim 8, wherein the weight, the calculator, and the light source are attached to one another in a manner such that the weight is capable of orienting the light source to project light to display on the display layer in a generally upward direction.

13. The golf ball according to claim 8, wherein the display layer is white.

14. The golf ball according to claim 8, further comprising a cover layer surrounding the display layer.

* * * * *